US007188818B2

(12) United States Patent
Chang

(10) Patent No.: US 7,188,818 B2
(45) Date of Patent: Mar. 13, 2007

(54) PORTABLE EASEL AND PALETTE COMBINATION

(76) Inventor: Eric Long-Chia Chang, 5622 Highgate Ter., Irvine, CA (US) 92612

( * ) Notice: Subject to any disclaimer, the term of this patent is extended or adjusted under 35 U.S.C. 154(b) by 307 days.

(21) Appl. No.: 10/400,287

(22) Filed: Mar. 28, 2003

(65) Prior Publication Data

US 2004/0031900 A1 Feb. 19, 2004

Related U.S. Application Data

(60) Provisional application No. 60/404,456, filed on Aug. 19, 2002.

(51) Int. Cl.
*A47B 27/00* (2006.01)

(52) U.S. Cl. ..... 248/460; 248/447; 248/458

(58) Field of Classification Search ..... 248/447, 248/448, 449, 450, 451, 452, 460, 463, 441.1; 312/231
See application file for complete search history.

(56) References Cited

U.S. PATENT DOCUMENTS

| | | | | |
|---|---|---|---|---|
| 1,065,255 | A | 6/1913 | Kuhrt | |
| 2,067,309 | A | 1/1937 | Wogaman | 45/131 |
| 2,586,524 | A | 2/1952 | Dussardier | 45/129 |
| 2,680,932 | A | 6/1954 | Rotschild | 45/129 |
| 2,751,271 | A | 6/1956 | Dessertenne et al. | 312/231 |
| 2,897,032 | A | 7/1959 | Kremer | 312/231 |
| 3,031,247 | A | 4/1962 | Schieve | 312/231 |
| 3,168,363 | A | 2/1965 | Monsour | 312/231 |
| 3,202,471 | A | 8/1965 | Wilson | 312/231 |
| 3,239,297 | A | 3/1966 | Bosko et al. | 312/231 |
| 3,378,322 | A | 4/1968 | Johnson | 312/231 |
| 3,414,343 | A | 12/1968 | Thomas | 312/231 |
| 3,476,456 | A | 11/1969 | Canavan | 312/231 |
| 3,514,173 | A | 5/1970 | Ford | 312/231 |
| 3,580,653 | A | 5/1971 | Thomas | 312/231 |
| 3,759,482 | A | 9/1973 | Wright | 248/449 |
| 4,042,203 | A | 8/1977 | Warkentin | 248/449 |
| 4,093,326 | A | 6/1978 | Ford | 312/231 |
| 4,372,630 | A | 2/1983 | Fuhri | 312/231 |
| 4,453,470 | A | 6/1984 | Capella | 108/26 |
| 4,460,105 | A | 7/1984 | Cox | 220/335 |
| 5,000,504 | A | 3/1991 | Munguia | 296/65.1 |
| 5,205,526 | A | 4/1993 | Deutsch | 248/449 |
| D344,637 | S | 3/1994 | Brown | D6/310 |
| 5,348,144 | A * | 9/1994 | Maier | 206/1.7 |

(Continued)

*Primary Examiner*—Ramon O. Ramirez
*Assistant Examiner*—Steven M. Marsh
(74) *Attorney, Agent, or Firm*—Sean D. Burdick

(57) ABSTRACT

A portable easel comprises an easelback and palette box joined by two lockable hinges mounted on opposing sides, the hinges having friction washers, and having knobs extending outward from shafts of each hinge, the shafts defining a rotational axis. With knobs loosened, the easelback may be rotated to a desired angle relative to the palette box, and, with knobs tightened, the friction washers lock the easelback into position. The easelback further comprises a canvas-holder having a vertically adjustable slidable lower support plate and a vertically extendable shaft, said shaft having a horizontal cross member configured with rotatable hooks for securing a canvas. The palette box further comprises a right-angle baseplate for tripod connection to advantageously place the opened easel's center of gravity at the baseplate-to-tripod connection. The easelback may comprise slots for storing canvases, and the palette box may be configured with multiple compartments for storing paints and accessories.

11 Claims, 16 Drawing Sheets

U.S. PATENT DOCUMENTS

| | | | | |
|---|---|---|---|---|
| 5,399,009 | A | 3/1995 | Hiner | 312/231 |
| 5,433,415 | A | 7/1995 | Samson et al. | 248/448 |
| 5,655,651 | A | 8/1997 | Maier | 206/1.7 |
| 5,662,303 | A | 9/1997 | Rellinger et al. | 248/448 |
| 5,791,623 | A | 8/1998 | Louridas | 248/451 |
| 5,833,201 | A | 11/1998 | Graybill | 248/462 |
| 5,950,979 | A | 9/1999 | Mira | 248/460 |
| 5,979,855 | A | 11/1999 | Maier | 248/447.1 |
| 6,053,467 | A | 4/2000 | Walker et al. | 298/450 |
| 6,206,183 | B1 | 3/2001 | Helsel | 206/1.7 |
| 6,296,213 | B1 * | 10/2001 | Law et al. | 248/166 |
| 6,308,925 | B1 | 10/2001 | Wilcox | 248/463 |

* cited by examiner

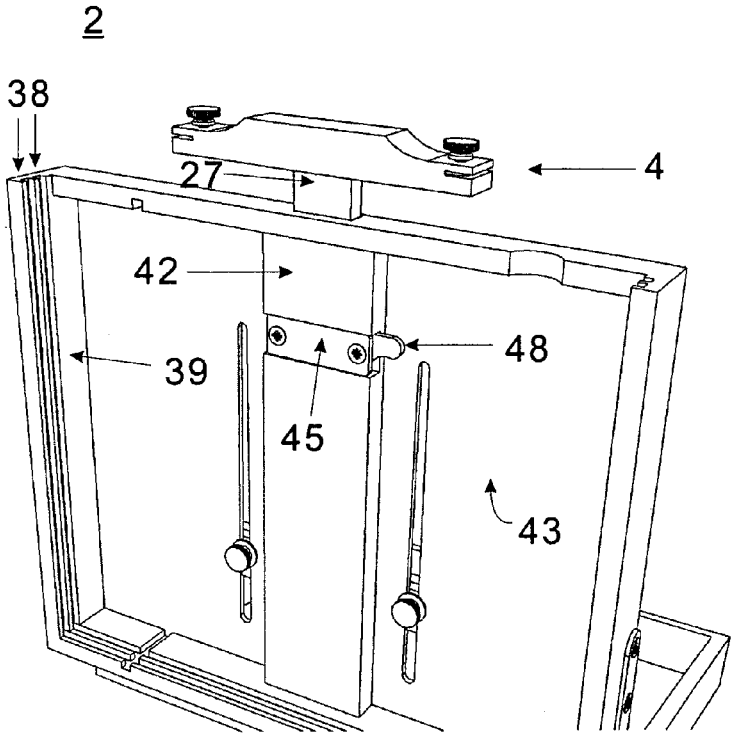
Fig. 9a
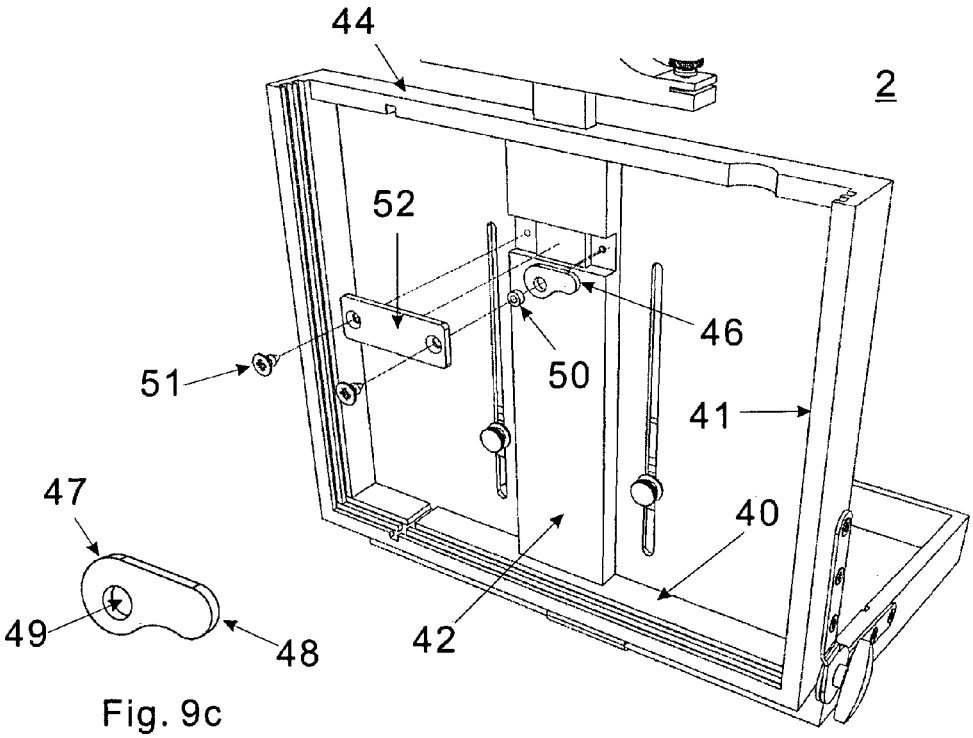
Fig. 9b
Fig. 9c

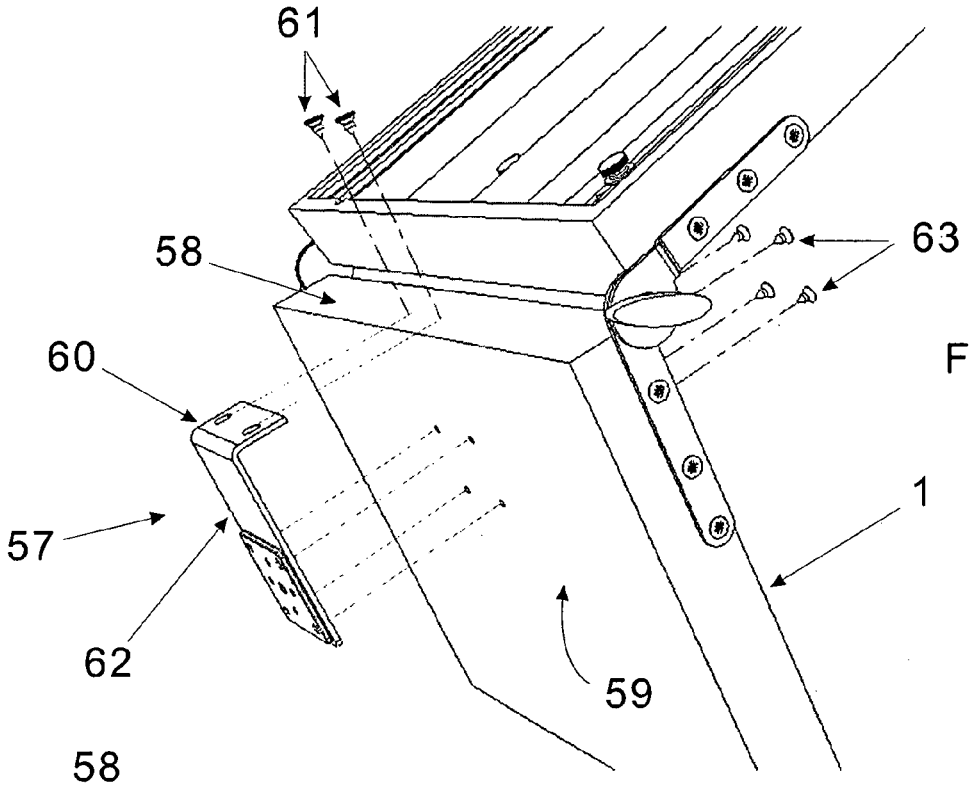
Fig. 11a
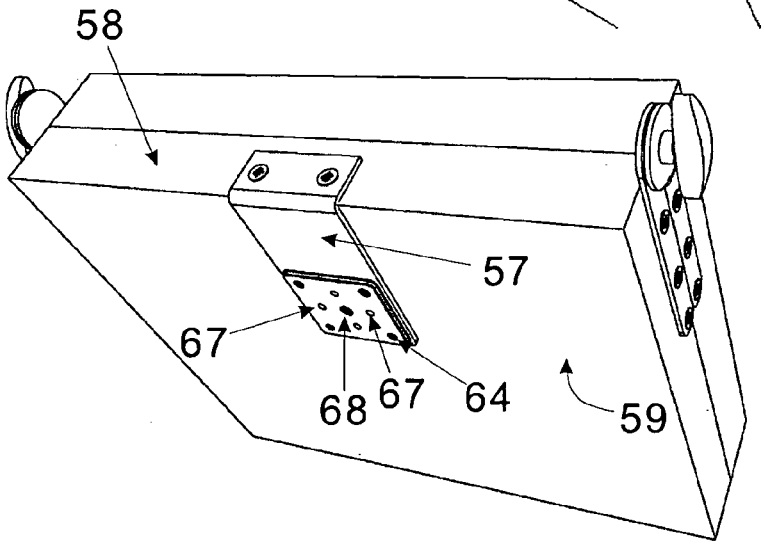
Fig. 11b
Fig. 11c
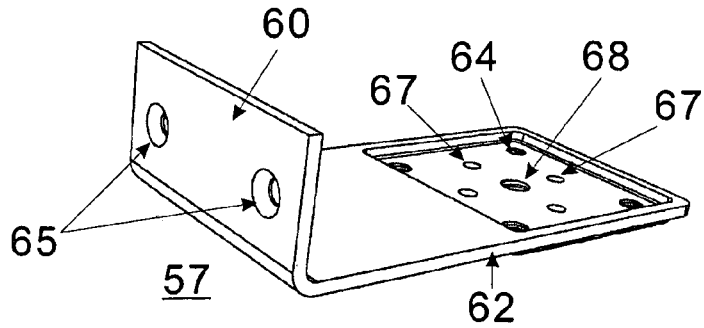

PORTABLE EASEL AND PALETTE COMBINATION

This application claims the benefit of U.S. Provisional Application No. 60/404,456 filed Aug. 19, 2002.

BACKGROUND

1. Field of the Invention

The present invention relates generally to the field of easels. More specifically, the invention relates to a portable easel and palette combination.

2. Related Art

In the field of fine arts, there exists an apparatus for supporting a painter's canvas commonly known as an easel. An easel is often combined with a palette mounted to the front of the easel for storing paint or other art supplies. The term "easel" as used hereinafter is understood to mean an easel and palette combination. The term "canvas" as used hereinafter is understood to mean generally a board, panel, sheet, plate, or like device, whether composed of canvas, paper, wood, or other material, mountable on an easel, to which an artist applies her medium.

Easels have been in use for many years; perhaps the most common design being a French-style easel. Generally, the French-style easel comprises a tripod structure that supports a framework, or "easelback", which holds an artist's canvas in place. See, e.g., various French-style easels manufactured by Jack Richeson & Co., Inc. of Kimberly, Wis. The French-style, and similar easels, have many disadvantages. They are heavy and cumbersome, and difficult to haul around. Their set-up is complicated and time-consuming. Their many component parts and hardware wear out or become lost.

Other easel designs are somewhat simplified or made portable by joining the easelback to the palette by means of butt hinges. The hinges allow the easelback to be opened to a desired angle with respect to the palette when the easel is in use, and re-closed by folding the easelback onto the palette for compact storage. See, e.g., U.S. Pat. No. 5,655,651. This, and other portable easels, may include a brace extending between the sides of the palette and easelback, or a supporting member to maintain the easelback at the desired angle. See, e.g., U.S. Pat. No. 4,093,326. Other easels may also provide a means for holding the artist's canvas against the easelback, for example, in the form of tension springs attached from the easelback to either side of the canvas. These and other easels may be supported by extendable leg sections connected directly to the palette, or by a detachable tripod support.

The aforementioned easels embody various designs for attaching an easelback to a palette that seek to overcome the following problems: (i) providing a means for pivotably attaching the easelback to the palette, (ii) providing a means for adjusting the easelback to a desired angle with respect to the palette, and (iii) providing a means for locking the angled easelback securely into position. Thus far, an elegant solution comprising one mechanism that solves these three problems has eluded those skilled in the art of easel design.

A conventional approach to solving the first problem is by installing one or more butt hinges between the easelback and palette. Butt hinges, however, are ill-suited for this application, due to the following failure mechanism to which easels are especially susceptible: with each brush stroke that presses on the canvas, a force, amplified by the moment arm of the easelback, acts to pry the hinges loose from their fastening hardware. Over time, the hinges loosen, causing the easel to wobble unacceptably.

An approach to solving the second problem is illustrated, for example, in U.S. Pat. No. 4,093,326, which uses a brace that connects the sides of the easelback to the sides of the palette. An unfortunate consequence of this arrangement is that the braces tend to obstruct the artist from freely stroking a brush across lower portions of the canvas. When the artist accidentally contacts a brace while stroking, paint gets undesirably ejected onto the palette and canvas. To prevent this problem, an artist must raise the level of her canvas higher than the side braces, but this creates an even longer moment arm causing additional stress to the hinges by the same failure mechanism described above. Other methods for adjusting the back at a desired angle have been attempted, such as a telescoping rod connecting the easelback to a supporting leg. Another example is shown in U.S. Pat. No. 5,655,651, wherein a rear-mounted brace connects the easelback to an extended side piece. However, these methods add to the overall weight, complexity, and set-up time.

An approach to solving the third problem, for locking the easelback into position, is commonly achieved by designs that use wing nuts or other separable fastening hardware that an artist must tighten by hand. See, e.g., U.S. Pat. No. 5,655,651. Often, however, these designs leave the artist to confront the frustrating problem of lost hardware while working in the field.

Other features of existing easel designs have been equally frustrating for artists. Easels having grooved blocks for holding the top of the canvas unduly limit canvas thickness, and also restrict the free flow of brush strokes. Easels having spring-tensioned hooks that grip the sides of a canvas unduly limit canvas width, and eventually, the springs become overly fatigued. Easels that use hinged legs for attachment to the palette tend to be heavy and tedious to assemble. Easels having tripod mounting plates screwed to the bottom of the palette, when assembled to a tripod, put excessive strain on the bottom of the palette by leverage applied over the distance between the plate and the bottom of the tripod, eventually causing a structural failure.

It is apparent from the foregoing discussion that there presently exists a need for a light-weight, portable, easel-and-palette combination having a durable and elegant means for attaching the palette to the easelback, for adjusting the angle of the easelback, for locking the back in its adjusted position, for mounting the palette to a support structure, and for accommodating a wide range of canvas sizes, all facilitating quick set-up time without creating brush stroke obstructions when fully assembled.

SUMMARY OF THE INVENTION

The present invention overcomes problems inherent in the conventional design of portable easels by providing a novel design that substantially departs from the teachings of the prior art.

A portable easel comprises a first surface, or palette box, and a second surface, or easelback, joined by two lockable side-mounted tilting hinges. The hinges are mounted on opposite sides of the palette box and easelback. Each hinge comprises first and second members, each member having an extended mounting tab and a rotatable overlapping section. The tabs of the first and second members are fastened, respectively, along one end of a side of the palette box and along one end of a side of the easelback such that the overlapping sections are cooperatively aligned. The overlapping section of the first member is rotatably pinned to an overlapping section of the second member by a threaded shaft extending from the second member. The shaft passes through a friction washer located between the overlapping sections, and engages a threaded hole in a tightening knob, or handle. One knob on each hinge extends outward from the easel at the junction of the easelback and palette box. The hinges provide a fulcrum for the easelback, and may also lock the easelback into position when the knobs are tight. By loosening the knobs, a user may rotate the easelback about the axis of the shafts to a desired angle with respect to the palette box, and, by tightening the knobs, a user may clamp the friction washers between the overlapping sections to lock the easelback into position.

The easelback further comprises a canvas holder having a slidable lower support plate and a vertically extendable shaft. Attached across the top of the shaft is a horizontal cross member having horizontal slots cut into its left and right ends to form upper and lower halves of the cross member. Each slot houses a rotatable hook that may be freed for rotation or secured in place by means of a thumbscrew. The end of each hook opposite the secured end is bent at about 90 degrees. A user places a canvas on the lower support plate and against the easelback and extended shaft, then lowers the cross member sufficiently to allow the hook ends to be rotated tightly against the top of the canvas thereby securing the canvas to the easelback. The height of the canvas bottom above the palette box is adjustable by sliding the lower support plate along vertical slots in the easelback and clamping the bracket in place by tightening thumbscrews that extend through the slots and engage threaded holes in the bracket.

The palette box further comprises a baseplate for tripod connection. The baseplate is angled at about 90 degrees to form two sections. One section is attached to the underside of the palette box; the other section abuts, and is attached to, the rear side of the palette box between the hinges. The underside baseplate section includes a means for attachment to the top of a tripod. The baseplate is located such that, when the easel is open and fully assembled to a tripod, its center of gravity is at or near the baseplate-to-tripod connection.

Many advantages are realized by the present invention. It provides an artist with a lightweight, portable device that comprises both easel and palette. It is very simple to assemble. It can hold a canvas at an adjustable angle. It can hold a wide range of canvas sizes. It does not obstruct brush strokes. It mounts easily to a tripod without putting strain on the palette. It provides a closeable volume for storing paint. It avoids the problem of lost hardware. And, it provides lockable hinges with greater service life and reliability than conventional hinges of the prior art.

BRIEF DESCRIPTION OF THE DRAWINGS

FIG. 9*a* is a rear view of an easelback with rear panel removed, showing a means for locking a canvas holder.

FIG. 9*b* is a rear view of an easel according to the invention, showing an exploded view of the locking means of FIG. 9*a*.

FIG. 9*c* is a magnified view of a snap lock tab.

FIG. 11*a* illustrates an arrangement for mounting a baseplate to an easel according to the invention.

FIG. 11*b* illustrates a baseplate mounted to an easel of the present invention shown in a closed position.

FIG. 11*c* is a magnified view of the baseplate of FIGS. 11*a* and 11*b*.

DETAILED DESCRIPTION OF THE INVENTION

Figure 1:
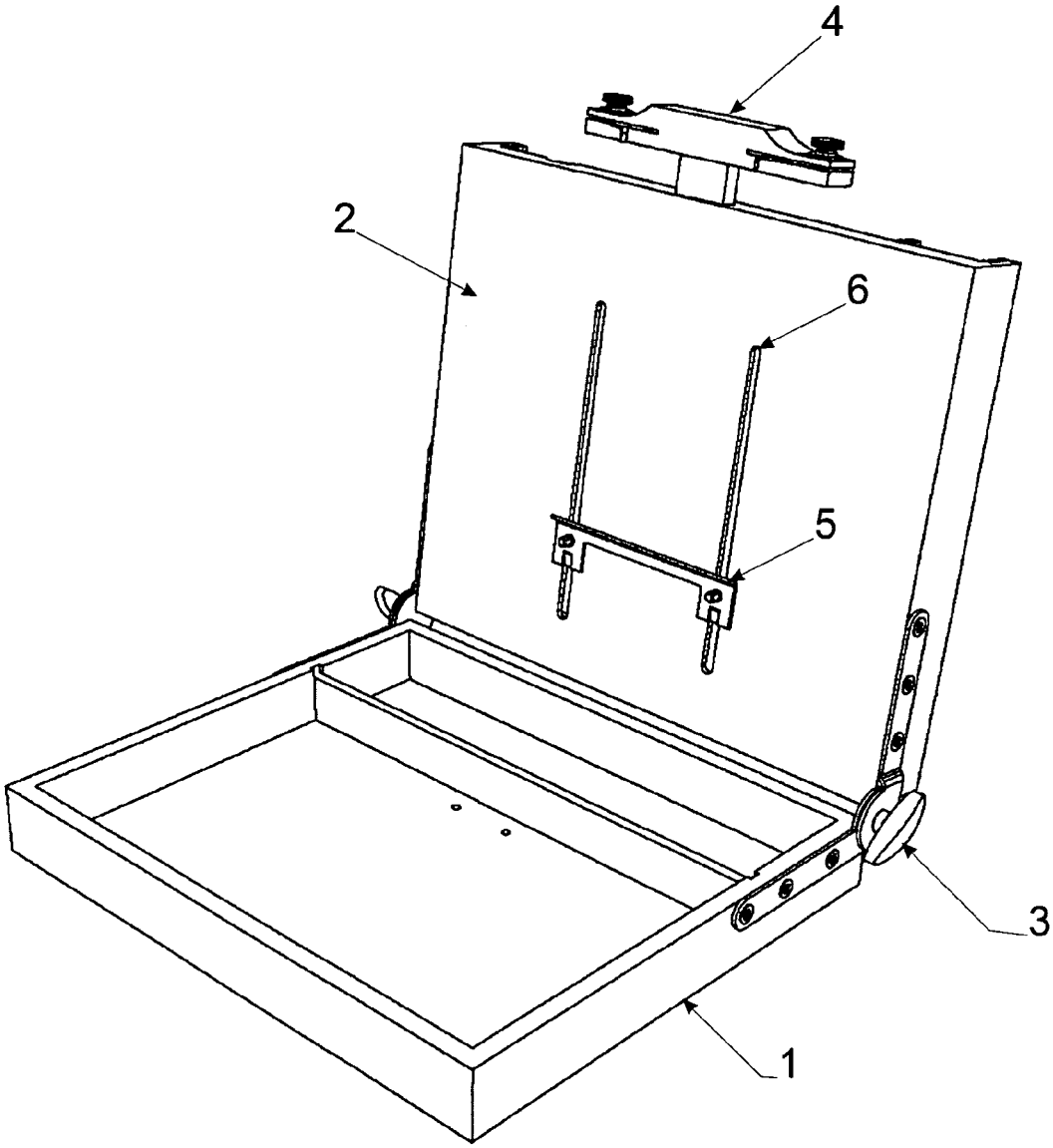
FIG. 1 is a frontal view of one embodiment of an easel according to the invention shown in an open position.

In accordance with the object of the invention set forth above, a preferred embodiment is now described in further detail, which, when read in conjunction with the claims and drawings, gives broader meaning and scope to the spirit of the invention. In the drawings, like reference numerals designate corresponding parts throughout the several views.

As utilized herein, terms such as "about" and "substantially" and "nearly" are intended to allow some leeway in mathematical exactness to account for tolerances that are acceptable in the trade. Accordingly, any deviations upward or downward from the value modified by the terms "about" or "substantially" or "near" in the range of 1% to 20% should be considered to be explicitly within the scope of the stated value.

Figure 2:
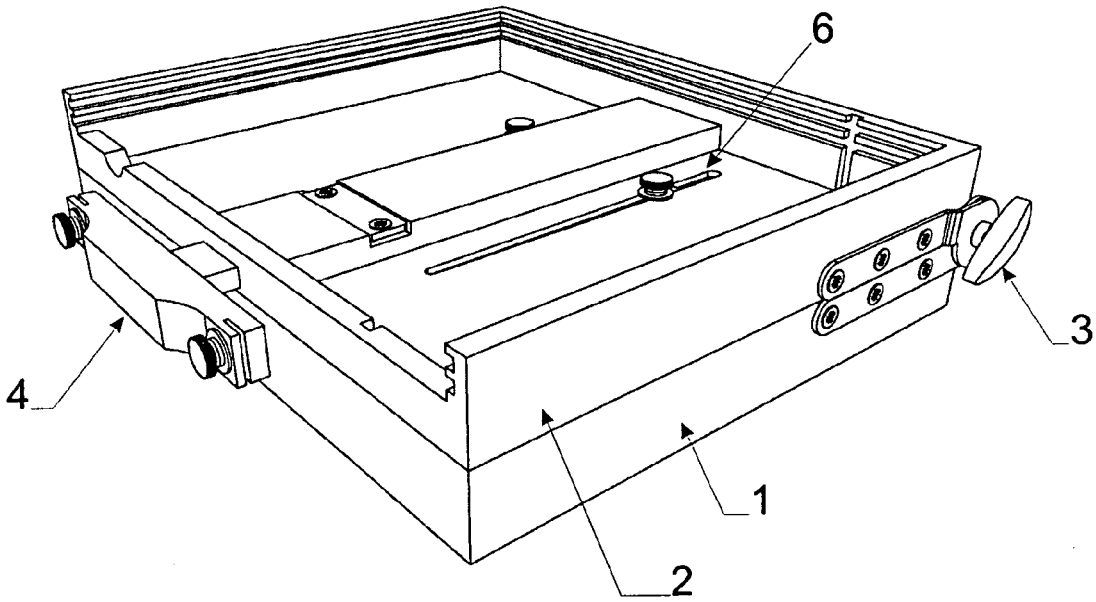
FIG. 2 shows an easel according to the invention in a closed position.
Figure 3:
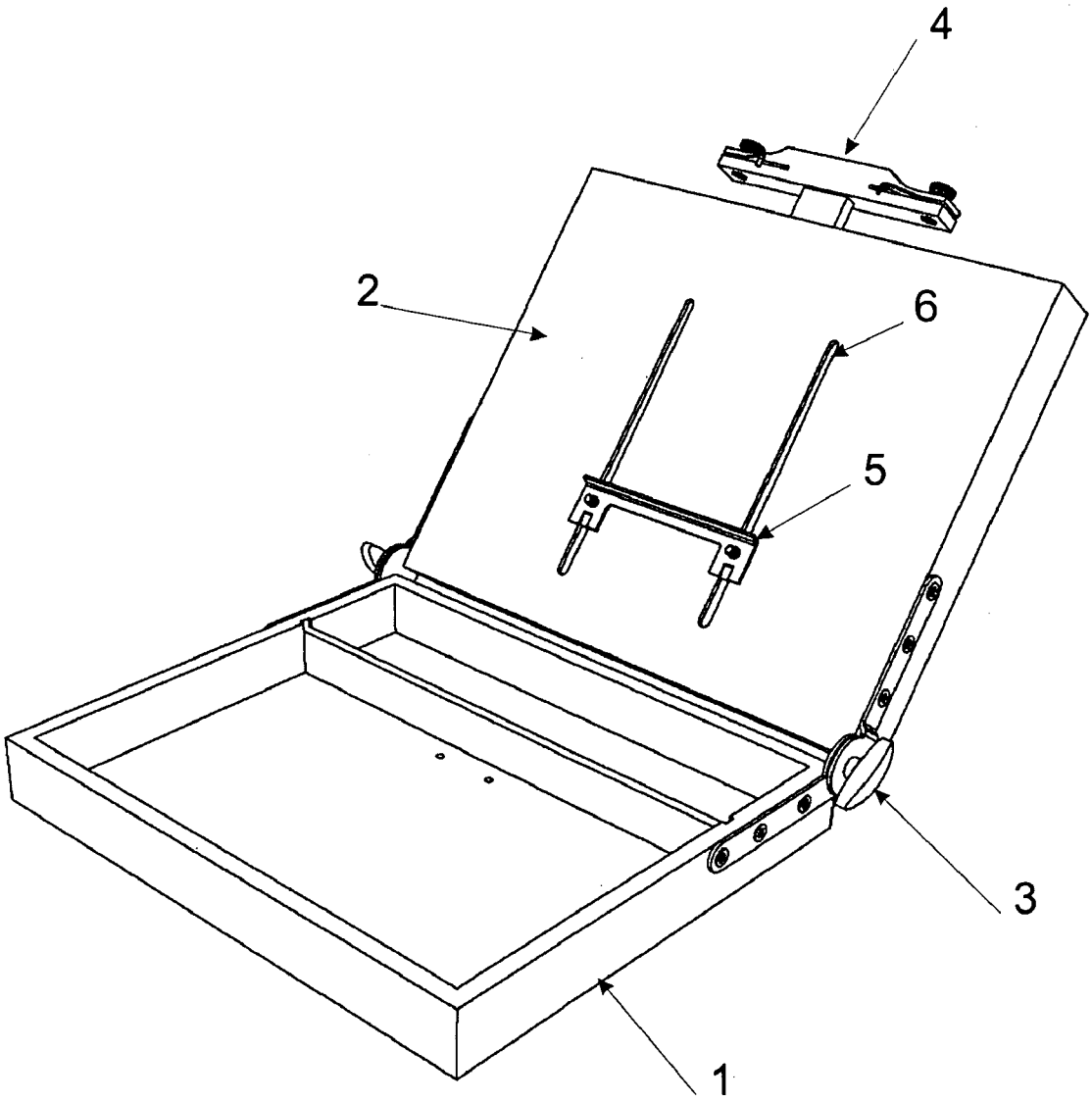
FIG. 3 is frontal view of the easel of FIG. 1, illustrating the easelback tilted at a variable angle.
Figure 4:
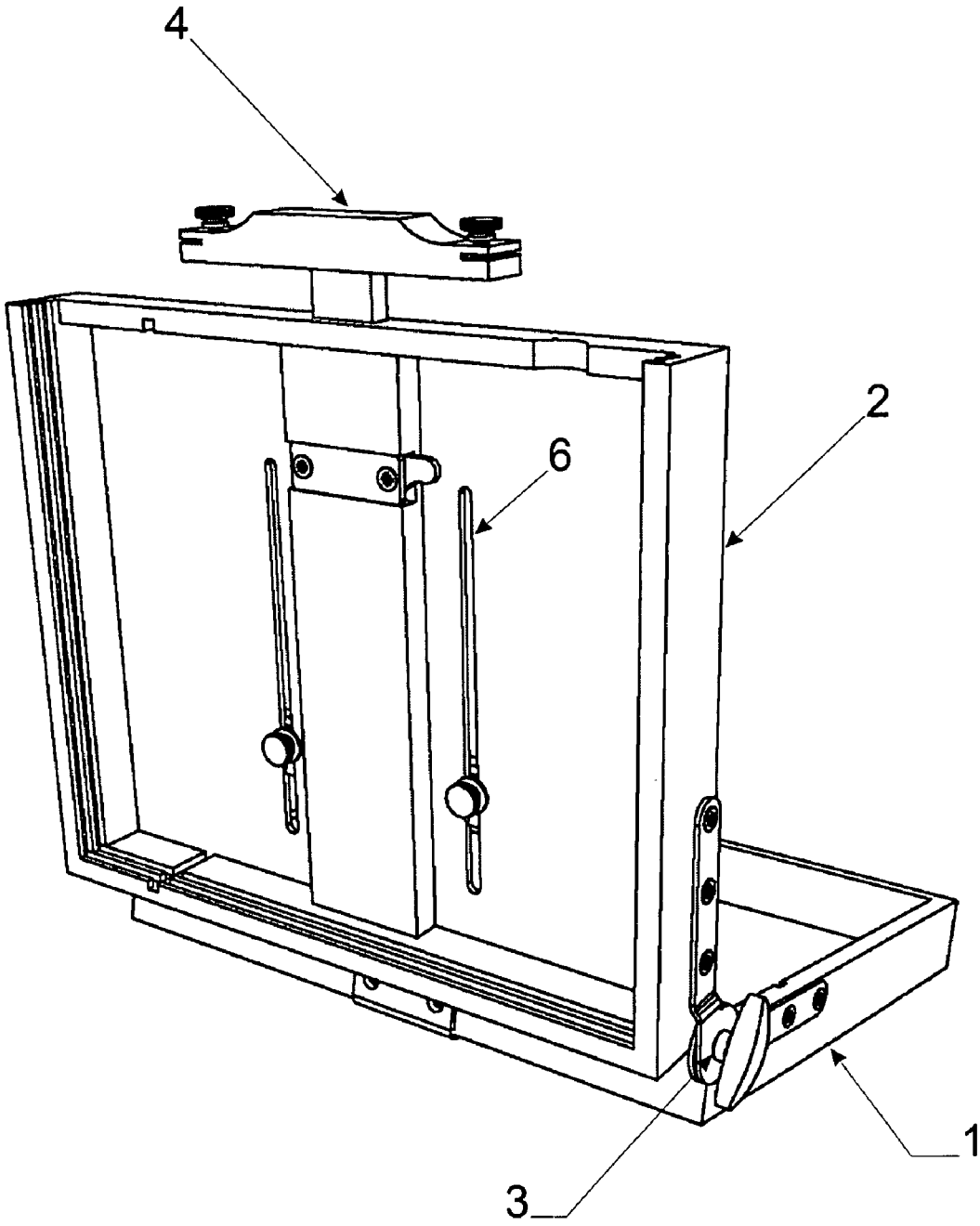
FIG. 4 is a rear view of an easel according to the invention.

FIG. 1 illustrates one embodiment of an easel according to the invention. The easel comprises a first surface 1 (hereinafter "palette box 1") bordered by sides, hinged to bordering sides of a second surface 2 (hereinafter "easelback 2") by a pair of lockable side-mounted tilting hinges 3, the hinges mounted opposite one another, as shown. The easel includes a means for securing an artist's canvas to easelback 2, consisting of an adjustable canvas holder 4 attached to easelback 2, and a canvas support plate 5 having a position that is adjustable along the length of vertical slots 6 cut into the bottom face of easelback 2. By means of hinges 3, easelback 2 can be rotated relative to palette box 1 from an open position, as shown in FIG. 1, to a fully closed position, as shown in FIG. 2. In the fully closed position, easelback 2 sits directly on top of palette box 1, as shown. From the fully closed position, hinges 3 allow easelback 2 to be rotated about 180 degrees to a fully open position. FIG. 3 shows easelback 2 tilted to an intermediate angle between the fully open and fully closed positions. During normal use, easelback 2 is tilted to an intermediate angle, and then locked into an open position as shown in FIGS. 1 and 2. FIG. 4 shows a rear view of the same easel.

Easelback 2 and palette box 1 may be formed from any sturdy material, preferably wood, but may also be formed from a lightweight metal or plastic. Components such as hinges 3, support plate 5, and various other hardware shown throughout the figures may be composed of a metal, preferably a corrosive-resistant metal, such as brass, plated steel, or stainless steel. Fasteners installed in the easel are also preferably metal, composed of material similar to hardware components to which the fasteners are attached.

Figure 5C:
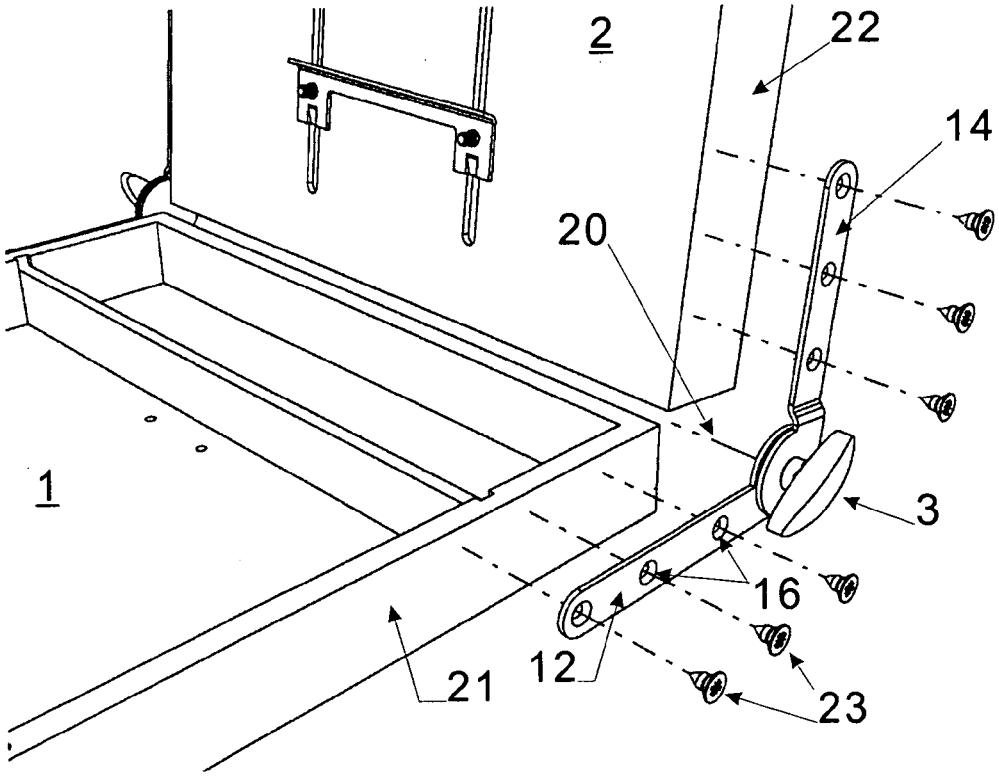
FIG. 5*c* shows a mounting arrangement for the hinge of FIG. 5*a* on an easel according to the invention.
Figure 5B:
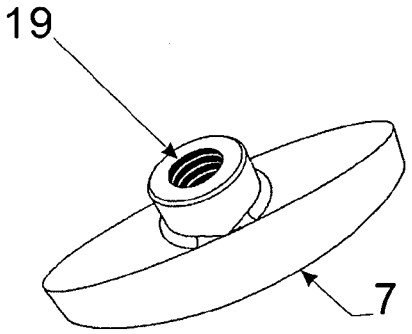
FIG. 5*b* is a magnified view of a knob of the hinge of FIG. 5*a*.
Figure 5A:
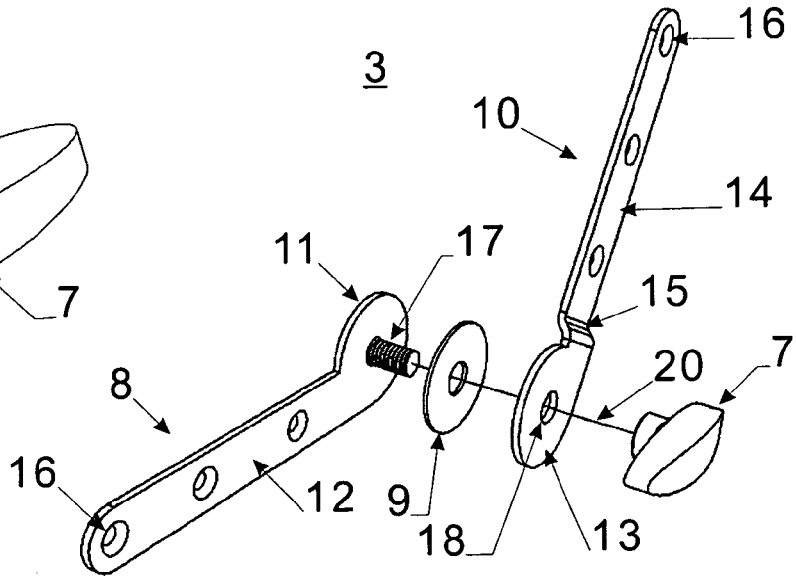
FIG. 5*a* illustrates an exploded view of an embodiment of a lockable side-mounted tilting hinge according to the invention.

FIGS. 5*a*, 5*b*, and 5*c* show one embodiment of a lockable side-mounted tilting hinge 3 in greater detail. As shown in FIG. 5*a*, hinge 3 comprises a locking knob 7, a first member 8, a friction washer 9, and a second member 10. Knob 7 is shown in magnified view in FIG. 5*b*. First member 8 comprises a rounded overlapping section 11 and an extended mounting tab 12. Second member 10 comprises a rounded overlapping section 13 offset from an extended mounting tab 14 by offset angle 15. Friction washer 9 has a diameter nearly equivalent to the diameters of overlapping sections 11 and 13. Tabs 12 and 14 each contain one or more mounting holes 16 located along the length of either tab. A threaded shaft 17 extends perpendicularly outward from the center of section 11. Section 13 defines an unthreaded hole 18 located at its center. When hinge 3 is assembled, friction washer 9 is sandwiched between sections 11 and 13 as shaft 17 passes through friction washer 9 and hole 18 to engage a threaded hole 19 in the center of locking knob 7. With hinge 3 thus assembled, the axis of shaft 17 becomes the rotational axis 20 for hinge assembly 2, as shown.

In another embodiment of a lockable side-mounted tilting hinge 3 of the present invention, hinge 3 comprises the same component parts as the embodiment of FIG. 5*a*, with locations of shaft 17 and threaded hole 19 interchanged. Thus, a shaft would extend perpendicularly outward from knob 7, passing through hole 18 in section 13 and through washer 9 to engage a threaded hole located in the center of section 11.

FIG. 5*c* shows an exploded view of an arrangement for mounting a hinge 3 to an easel according to the invention. Mounting tab 12 is aligned along one outer side 21 of palette box 1. Similarly, mounting tab 14 is aligned along one outer side 22 of easelback 2. Tabs 12 and 14 are secured to palette box 1 and easelback 2, respectively, by fasteners 23 that pass through holes 16 and engage outer sides 21 and 22. Proper alignment of tabs 12 and 14 locates the rotational axis 20 to allow easelback 2 to rotate to the fully closed position, and from there, to rotate about 180 degrees, without obstruction, to the fully open position. Fasteners 23 may be any fasteners suitable for the purpose, such as wood screws.

Referring again to FIGS. 1 through 5*c*, the locking operation of hinges 3 is now described. With easelback 2 locked in any desired position, a user grasps knobs 7, one knob in each hand, and turns each knob 7 in a counterclockwise direction. In the preferred embodiment, only about a quarter-turn is required to reduce the clamping force on friction washer 9 sufficiently to loosen a hinge 3. With hinges 3 so loosened, easelback 2 is released to freely rotate to a new position anywhere between the fully open and fully closed positions. When the new, desired position is achieved, easelback 2 may be locked into that position by tightening hinges 3 by turning knobs 7 clockwise, until friction washer 9 is clamped with sufficient force to prevent overlapping sections 11 and 13 from rotating relative to one another. In the preferred embodiment, a sufficient clamping force is easily provided by hand, so long as friction washer 9 is composed of material that creates a high coefficient of friction between friction washer 9 and sections 11 and 13. For example, friction washer 9 may be composed of a resilient plastic, synthetic rubber, or other elastomer. Alternate embodiments of an easel of the present invention may comprise opposing hinges 3 having shafts 17 of identical thread directions or opposite thread directions.

Figure 6:
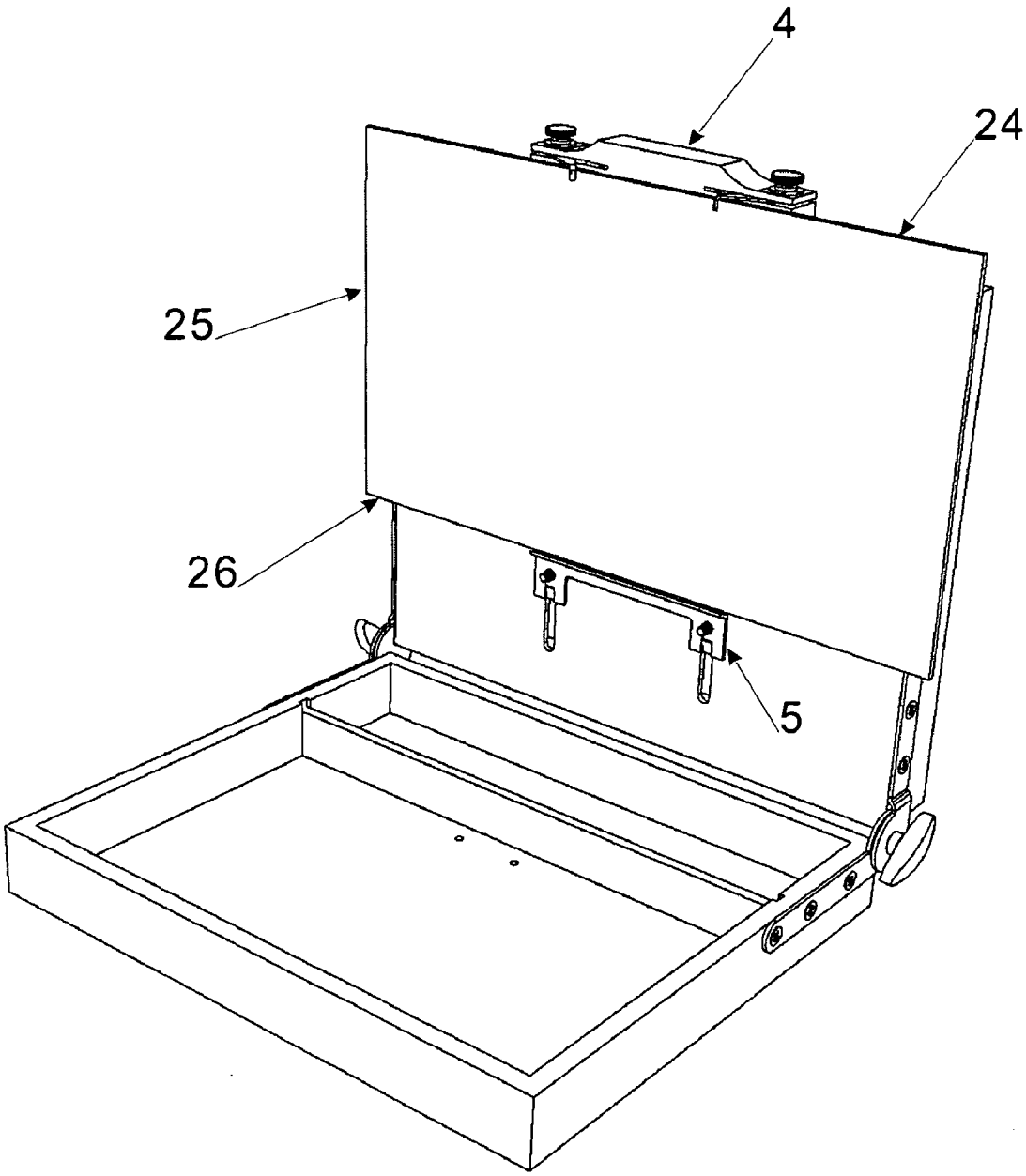
FIG. 6 illustrates a canvas attached to an easel of the present invention by means of an adjustable canvas holder.
Figure 7:
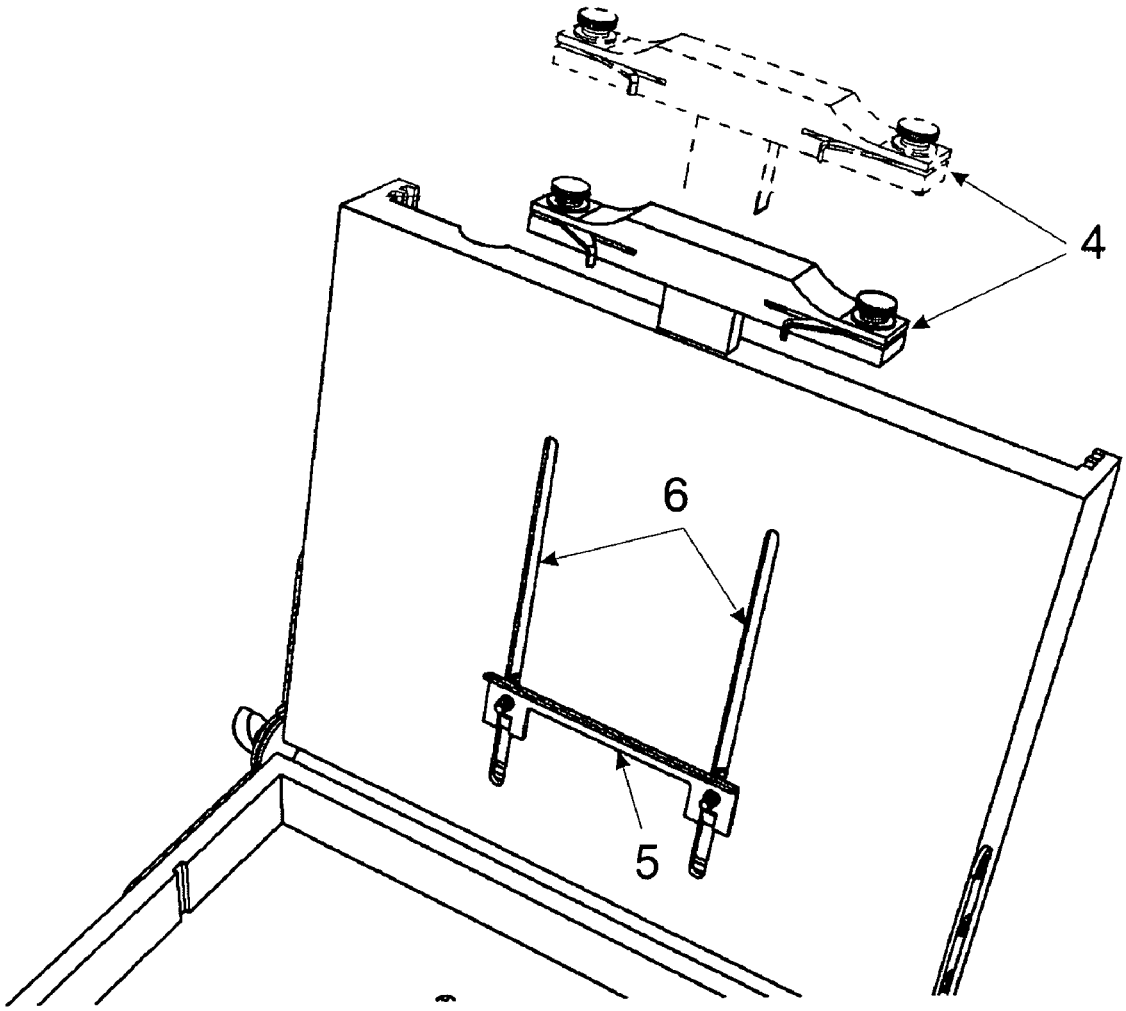
FIG. 7 is a frontal view of an easelback of the present invention, illustrating variable positions for an adjustable canvas holder.

Turning now to FIG. 6, an embodiment of a means for attaching an artist's canvas to easelback 2 is described. The means comprises an adjustable canvas holder 4 for supporting the upper end 24 of a canvas 25, and a support plate 5 for supporting the lower end 26 of canvas 25. The elevation of both holder 4 and support plate 5 may be adjusted, as required, to accommodate canvases of different sizes. Vertical adjustment of holder 4 is depicted in FIG. 7.

Figure 8A:
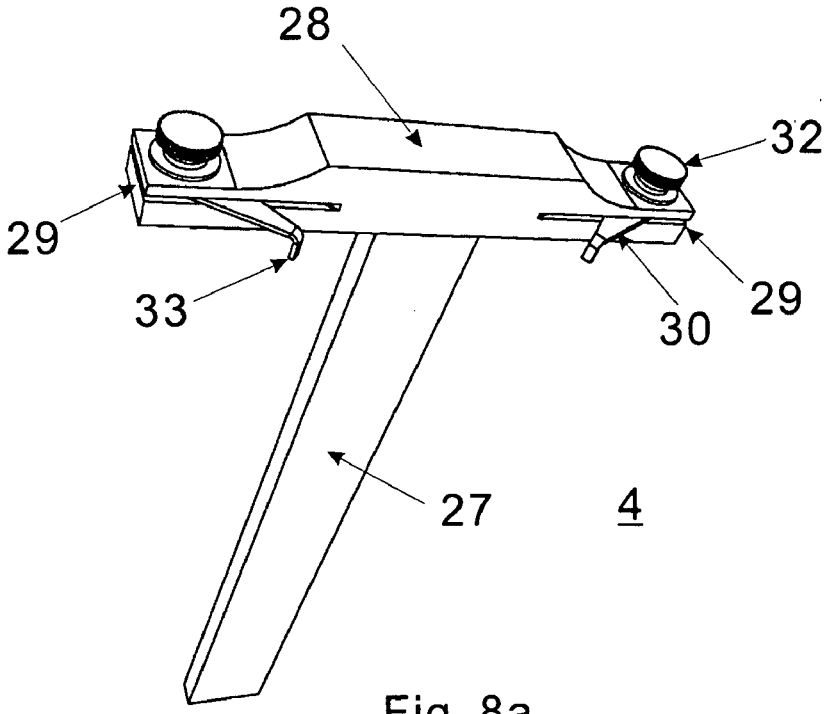
FIG. 8*a* depicts a canvas holder for an easel of the present invention, having a vertical shaft, horizontal cross member, and rotatable hooks.
Figure 8B:
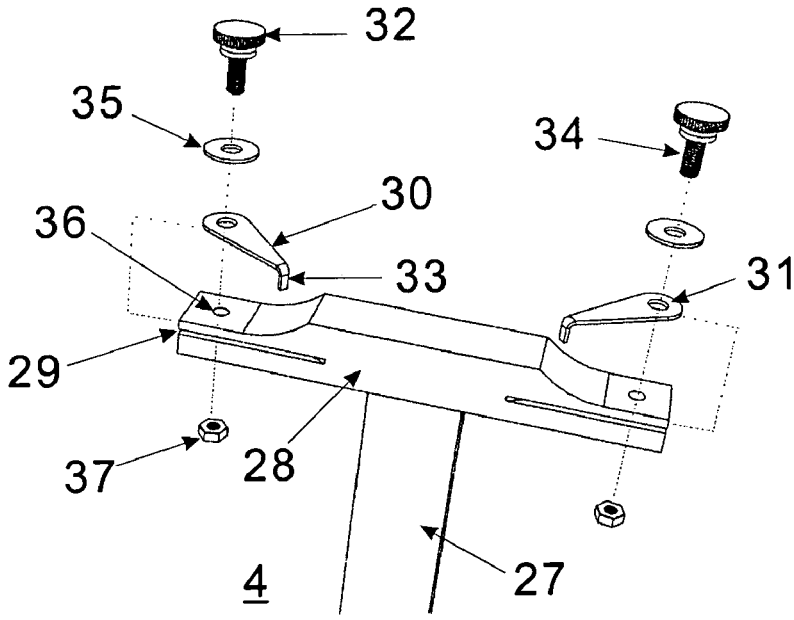
FIG. 8*b* is an exploded view of the canvas holder of FIG. 8*a*.

Holder 4 is shown in greater detail in FIGS. 8*a* and 8*b*. Holder 4 further comprises a vertical shaft 27 having across a horizontal cross member 28 mounted symmetrically across its top, as shown. Horizontal slots 29 are cut into the left and right ends of cross member 28 to divide cross member 28 into upper and lower halves. A slot 29 must be of sufficient size to accommodate a rotatable hook 30. Each hook 30 has a mounting hole 31, through which hook 30 is pinned into its slot 29 by a thumbscrew 32. A small portion 33 of each hook 30 is bent at about 90 degrees at the end opposite hole 31. The shaft 34 of thumbscrew 32 penetrates downward through a washer 35, through a vertical hole 36 in cross member 28, and engages a hex nut 37, as shown. Hex nut 37 is preferably imbedded into the underside of the lower half of cross member 28. By tightening a thumbscrew 32, an upper and lower half of cross member 28 compress sufficiently to clamp hook 30 into position. By loosening thumbscrew 32, hook 30 may be freely rotated into and out of its slot 29.

The vertically adjustable feature of canvas holder 4 is now described. FIGS. 9*a* and 9*b* show rear views of an embodiment of an easelback 2 of the present invention. In these views, an optional rear panel (not shown) has been removed from easelback 2 by sliding it out along one of a plurality of slots 38. Slots 38 comprise grooves cut into the inner sides 39, 40, and 41 of easelback 2, as shown. Easelback 2 further comprises a shaft housing 42 running down the center of rear side 43 of easelback 2, parallel to inner sides 39 and 41. Shaft 27 is inserted into housing 42 through a hole cut through top side 44. Preferably, housing 42 runs the entire length of easelback 2 in order to maximize the accommodatable length of a shaft 27. Shaft 27 slides smoothly within housing 42 to adjust the height of canvas holder 4 relative to top side 44. When shaft 27 is adjusted to a desired position, it may be locked into position by means of a locking device. Snap lock 45 is an example of one such locking device. Snap lock 45 is preferably located in close proximity to top side 44, because the closer this location is to top side 44, the farther shaft 27 may be extended vertically to accommodate larger sized canvases and still be held securely in place by snap lock 45.

FIG. 9*b* shows an exploded view of snap lock 45. Snap lock 45 comprises a tab 46 having rounded end 47 and a handle 48. Handle 48 protrudes from housing 42 to allow a user to operate the locking device. Rounded end 47 defines a mounting hole 49 that is located non-concentrically, as shown in FIG. 9*c*. A bushing 50 having a thickness slightly greater than tab 46 is installed in mounting hole 49. Tab 46 is rotatably mounted to housing 42 by a screw 51 that passes through plate 52 and bushing 50, and into housing 42.

FIG. 9*a* shows tab 46 in a locked position that holds shaft 27 tightly in place. To unlock shaft 27, tab 46 is rotated clockwise less than 90 degrees to an unlocked position. Because the axis of rotation of tab 46 is non-concentric with rounded end 47, rotation of tab 46 to the locked position causes rounded end 47 to press against shaft 27 with sufficient friction to arrest the movement of shaft 27 within housing 42. Conversely, rotation of tab 46 to the unlocked position causes rounded end 47 to lose contact with shaft 27, thereby allowing shaft 27 to slide freely within housing 42. Snap lock 45 is designed so that only minimal force is required to toggle handle 48 between its open and locked positions. Moreover, snap lock 45 is configured advantageously within housing 42 to comprise an automatic gravity lock when easelback 2 is open and canvas holder 4 is extended vertically. A skilled artisan reading this disclosure will recognize that if shaft 27 is allowed to fall into housing 42 by means of gravity, friction between shaft 27 and rounded end 47 will rotate tab 46 in a counter-clockwise direction to its locked position, thereby automatically arresting the fall of shaft 27.

Figure 10A:
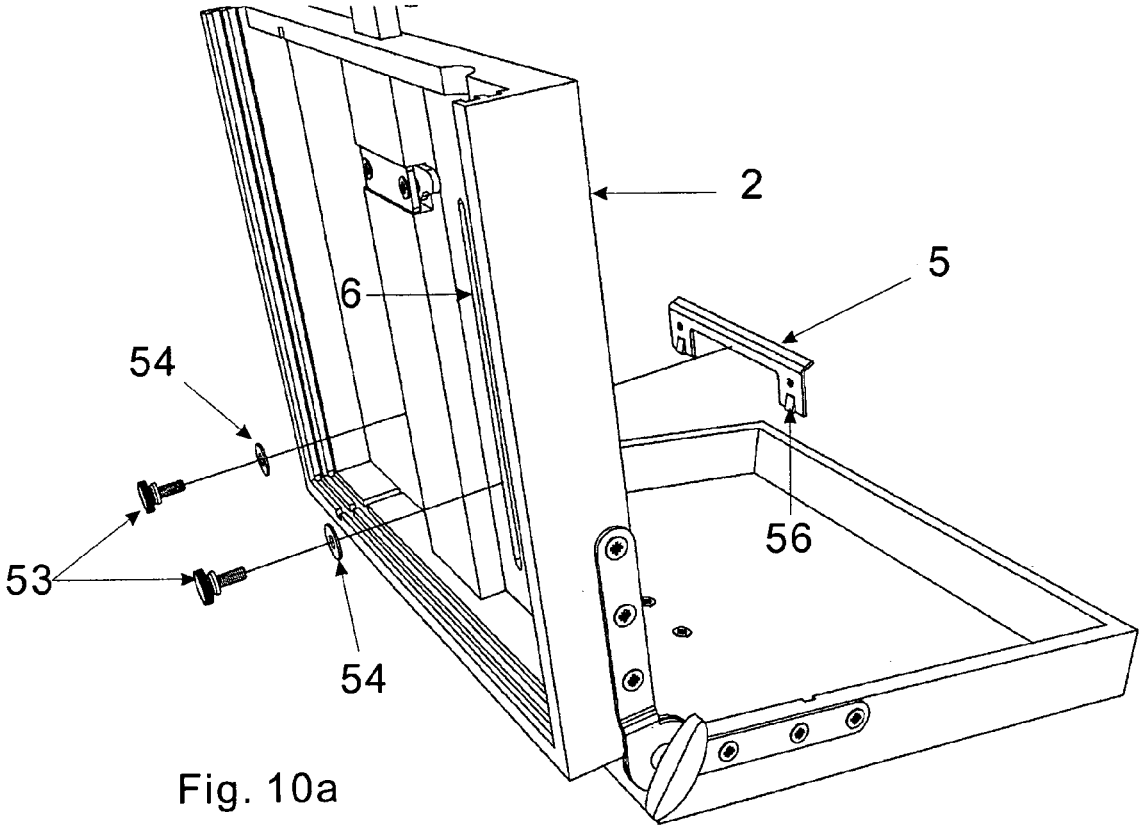
FIG. 10*a* illustrates an arrangement for mounting a canvas support plate to an easel according to the invention.

Canvas support plate 5 provides a means for vertical adjustment of a canvas mounted to an easel according to the invention. FIG. 10*a* shows one embodiment of canvas support plate 5, and a means for mounting it to an easelback 2. Support plate 5, which is located on the front, or canvas-supporting side of easelback 2 (see, e.g. FIG. 7), is attached thereto by thumbscrews 53 that penetrate washers 54 (optional) and slots 6 from the opposite side of easelback 2, as shown. Thumbscrews 53 engage threaded holes 55 in support plate 5, and thereby secure support plate 5 to easelback 2 by tightening. With this fastening arrangement, the height of support plate 5 above palette box 1 can be adjusted by loosening thumbscrews 53 and sliding them along slots 6, then tightening thumbscrews 53 when support plate 5 is at a desired position.

Figure 10B:
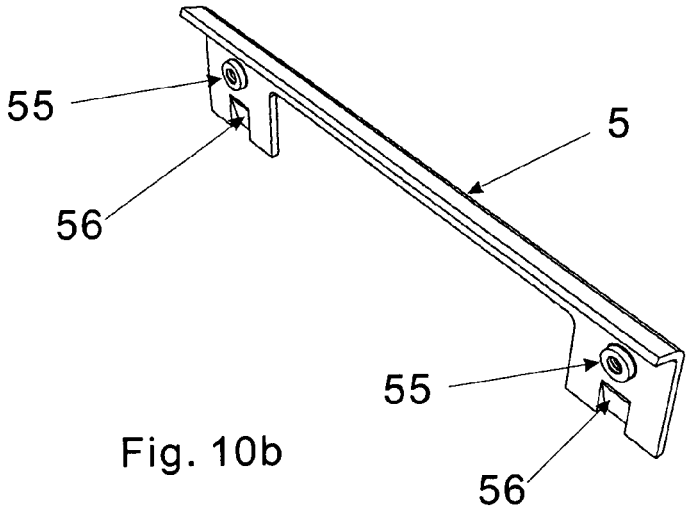
FIG. 10*b* is a magnified frontal view of the canvas support plate of FIG. 10*a*.

Support plate 5 comprises a support bracket having an angle 90 degrees or greater so that any canvas resting on top of support plate 5 will tend to incline against and substantially parallel to easelback 2, and into a stable position. The angle of support plate 5 preferably exceeds 90 degrees by about 10 degrees. Preferably, support plate 5 may be configured with rails 56. Rails 56 slide snugly within slots 6, thereby maintaining support plate 5 substantially perpendicular to slots 6 while support plate 5 is moved upward or downward. FIG. 10*b* shows a magnified frontal view of one embodiment of a support plate 5 having rails 56 formed directly from the plate.

An easel according to the present invention may also be configured with a means for mounting the easel to a conventional tripod. As shown in FIGS. 11*a* and 11*b*, a baseplate 57 is mounted to both the rear side 58 and bottom surface 59 of palette box 1. Baseplate 57 comprises a right-angle bracket, having a first portion 60 mounted to rear side 58 by fasteners 61, and a second portion 62 mounted to bottom surface 59 by fasteners 63. Fasteners 61 are preferably wood screws that engage rear side 58. Fasteners 63 are preferably machine screws that mate to threaded holes 64 drilled into second portion 62.

FIG. 11*c* shows baseplate 57 in greater detail. In one embodiment, baseplate 57 is machined from a single piece of flat metal, about 2 mm thick, and is generally rectangular in shape. First portion 60 comprises about 20% to 25% of its length, and is bent at an angle of about 90 degrees relative to second portion 62. First portion 60 defines mounting holes 65 for accommodating fasteners 61. Second portion 62 comprises the remaining length, and includes a recessed area 66 that defines holes 64. The width of baseplate 57 is about 15% to 20% of the width of palette box 1, and about 30% to 40% of the combined length of portions 60 and 62.

Additionally, area 66 is designed to interface with a common mounting configuration available in many conventional tripods. One such configuration on a tripod consists of a threaded stud and a spring-loaded pin. FIGS. 11*b* and 11*c* show a complimentary receptacle in area 66 of baseplate 57 that consists of four pinholes 67 spaced evenly about a threaded hole 68. Threaded hole 68 mates directly to the threaded stud of the tripod, and when the stud is fully engaged, the tripod's spring loaded pin snaps into one of the four pinholes 67 to complete the connection. Thus connected, and with easelback 2 rotated about 90 degrees relative to palette box 1, the center of gravity of the easel occurs advantageously at or near the baseplate-to-tripod connection. Moreover, because baseplate 60 is mounted securely to both the rear side 58 and bottom 59 of palette box 1, any stresses on the tripod-to-palette connection are advantageously distributed over normal planes, 60 and 62. This provides a stronger and more stable method for connecting a tripod to a palette than any connecting arrangement known to exist in the field of easel design.

Figure 12A:
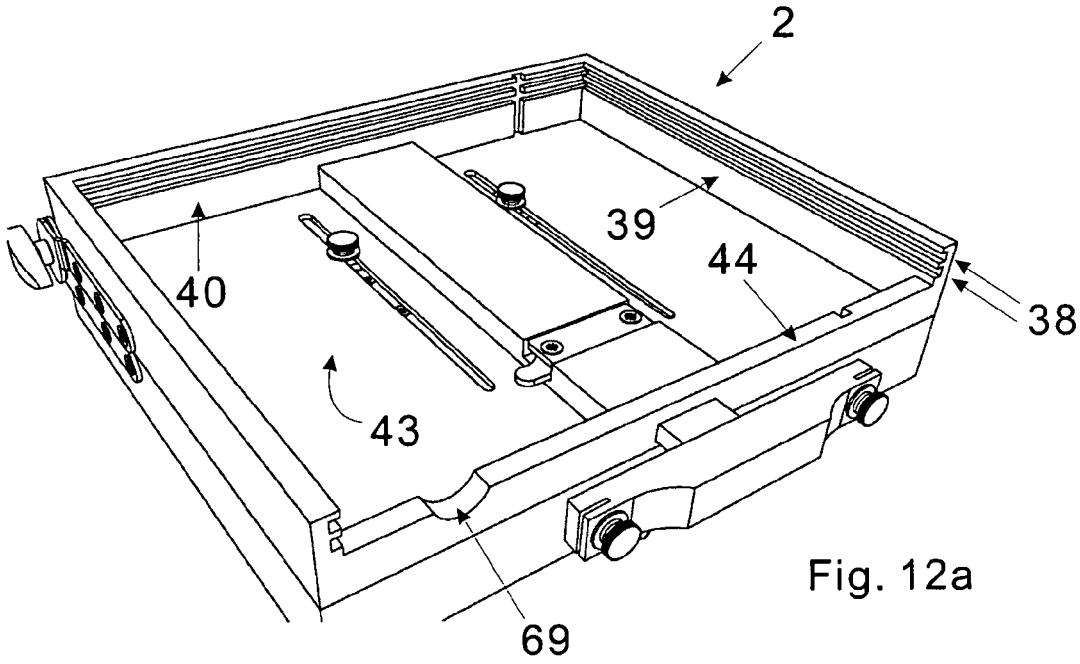
FIG. 12*a* shows a rear view of an easelback of the present invention with optional back panel removed.
Figure 12B:
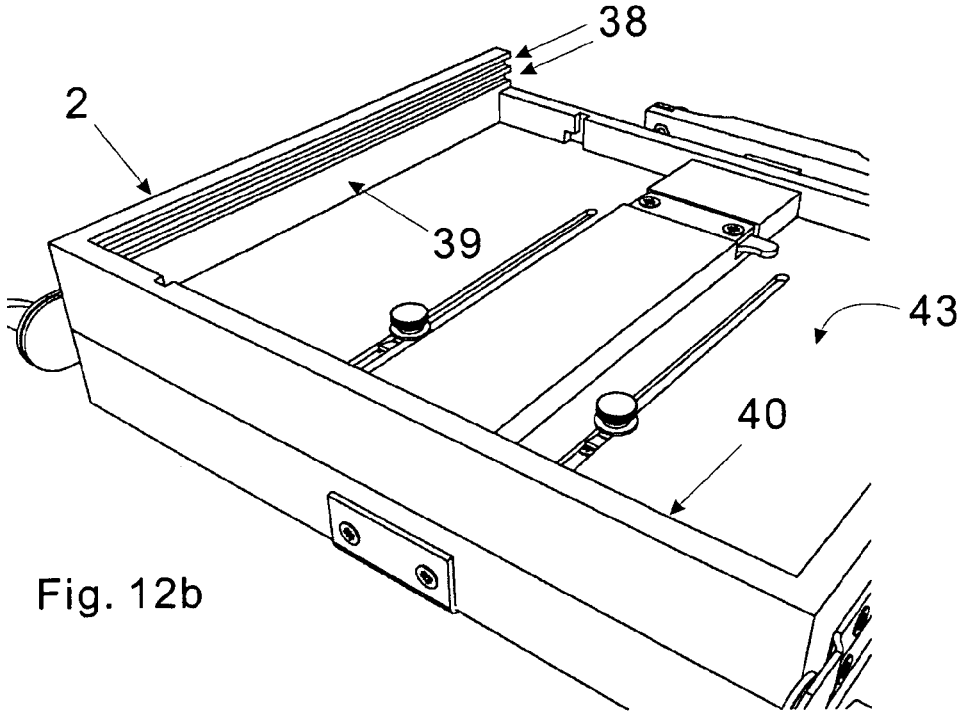
FIG. 12*b* is another rear view of an easelback of the present invention with optional back panel removed.
Figure 13A:
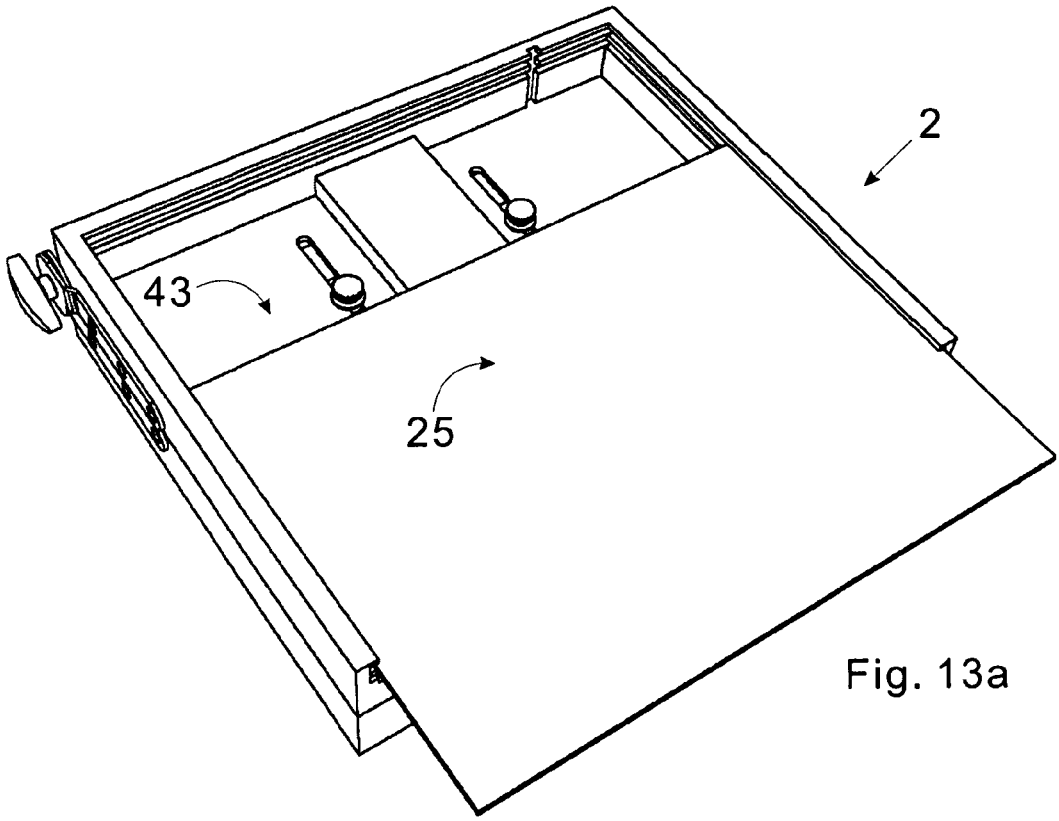
FIG. 13*a* illustrates a means for storing a canvas into an easel according to the invention.
Figure 13B:
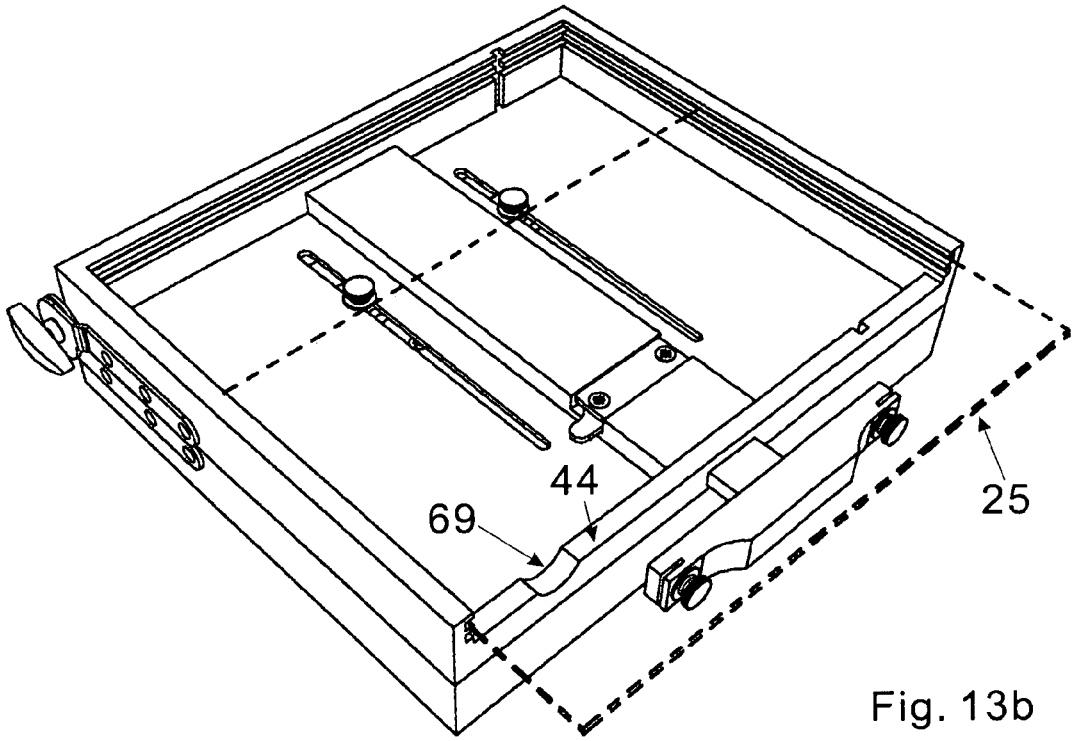
FIG. 13*b* illustrates the easel of FIG. 13*a* with the canvas shown in cutaway.

A means for storing a canvas within an easel according to the invention is now described. FIGS. 12*a* and 12*b* show rear side 43 of easelback 2. As noted above, a plurality of slots 38 are cut into the inner sides 39, 40, and 41 of easelback 2 (side 41 is shown in FIG. 9*b*), and a back panel may be installed in slots 38 to provide a smooth protective surface for the rear side 43 of easelback 2. In lieu of, or in addition to, a protective back panel, an artist's canvas 25 having an appropriate width and thickness may also be conveniently stored there by sliding canvas 25 into one of the slots 38, as shown in FIGS. 13*a* and 13*b*. Slots 38 are sized to accommodate the thickness of a canvas 25 snugly, so that a canvas 25 may be inserted by hand into a slot 38 without undue difficulty, and so that a canvas 25 will not easily slide out from a slot 38 when an easelback 2 is tilted at an angle. Additionally, hooks 30 may be positioned to prevent a canvas from falling out of slots 38. Slots 38 may be sized similarly, or they may be sized differently so that an easelback 2 may snugly accommodate canvases having different thicknesses. Using this method, an artist in the field using an easel of the present invention may advantageously load blank canvases into the easel for convenient transport. In addition, the artist may safely store and carry wet canvases within slots 38 in the same fashion. A cutout 69 may be provided on the top side 44 of easelback 2 to facilitate removal of a canvas 25 from slots 38.

Figure 14A:
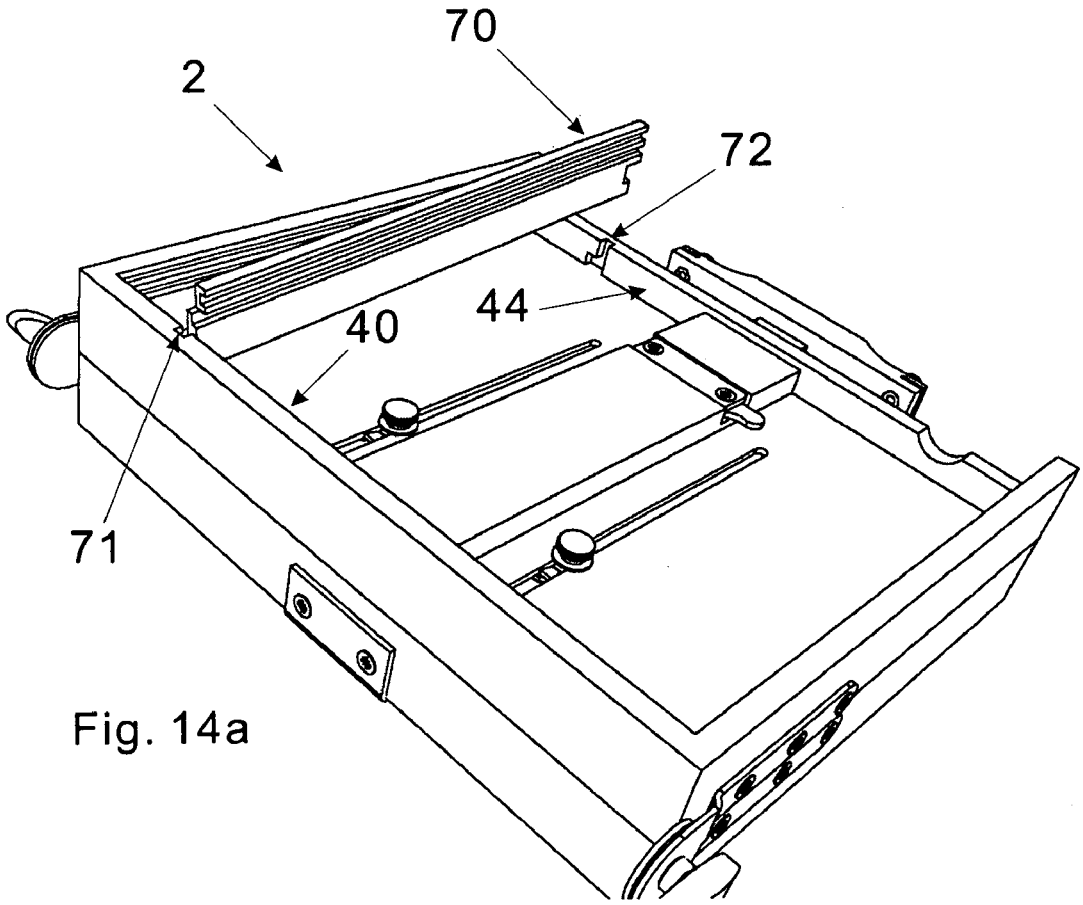
FIG. 14*a* shows an easel of the present invention configured with an optional slotted rail.
Figure 14B:
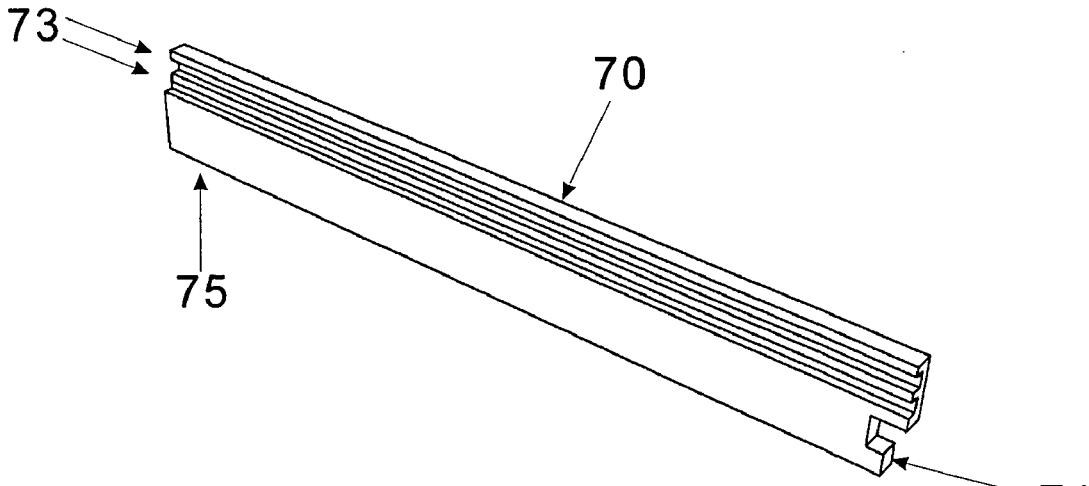
FIG. 14*b* shows a magnified view of the slotted rail of FIG. 14*a*.
Figure 15A:
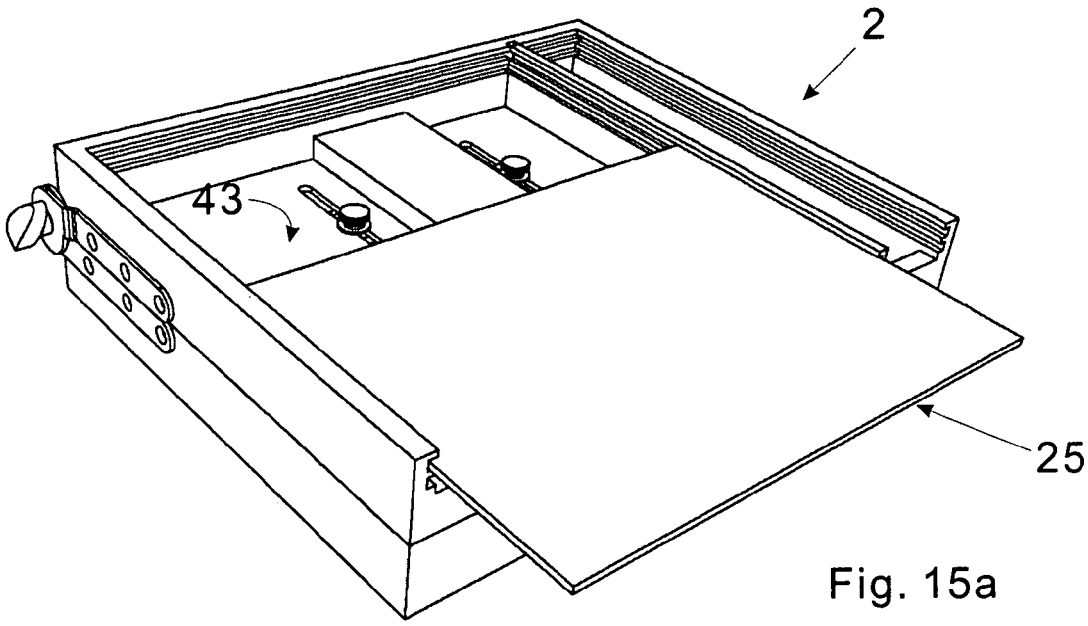
FIG. 15*a* illustrates a means for storing a canvas into an easel according to the invention using an optional slotted rail.
Figure 15B:
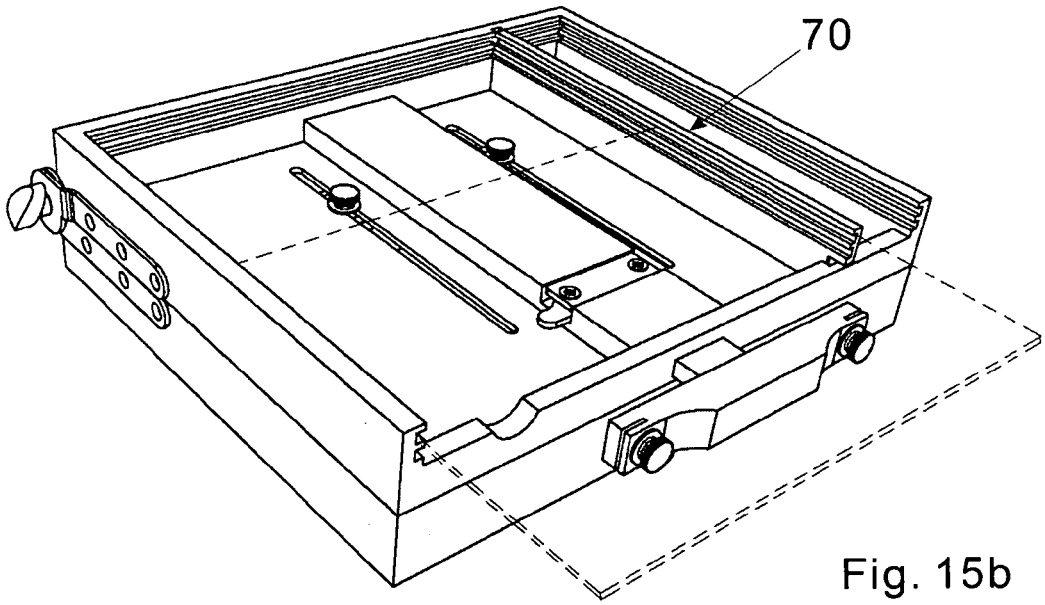
FIG. 15*b* illustrates the easel of FIG. 15*a* with the canvas shown in cutaway.

In order to store canvases having widths smaller than the width of easelback 2, an optional slotted rail 70 may be installed into rear side 43 of easelback 2, as shown in FIG. 14*a*. To accommodate rail 70, a straight groove 71 is cut into the inner surface of side 40, and an L-shaped groove 72 is cut into top side 44. Rail 70 is shown in greater detail in FIG. 14*b*. Rail 70 is configured with slots 73 sized identically to slots 38. In addition, the top end of rail 70 comprises a notch 74 that fits within L-shaped groove 72. To install rail 70, the bottom end 75 of rail 70 is inserted into straight groove 71. Then, notch 74 is placed into L-shaped groove 72 and moved toward side 39 so that notch 74 snugly engages the bottom leg of the L, thereby positioning rail 70 parallel to side 39. With rail 70 thus installed, one or more canvases 25 may be stored at rear side 43 of easelback 2 as shown in FIGS. 15*a* and 15*b*. By adding additional sets of grooves to other locations on sides 40 and 44, an easel according to the invention may store canvases of varying widths.

Figure 16A:
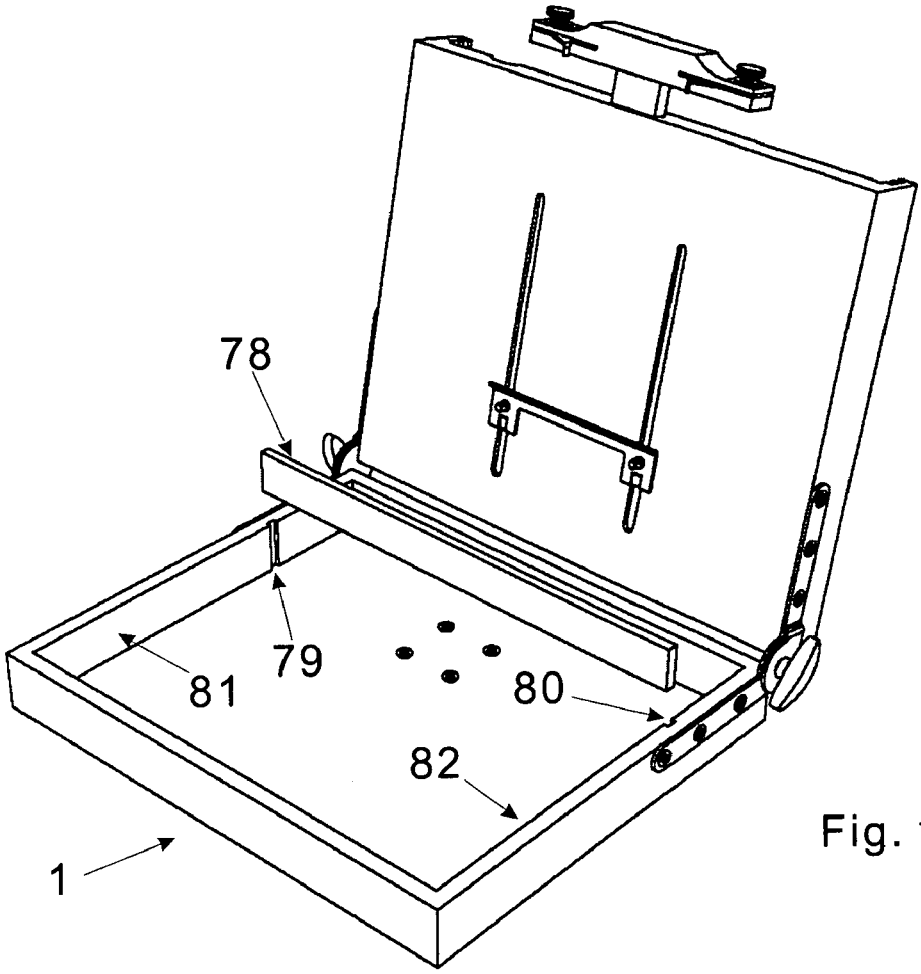
FIG. 16*a* shows an easel of the present invention configured with an optional separator.
Figure 16B:
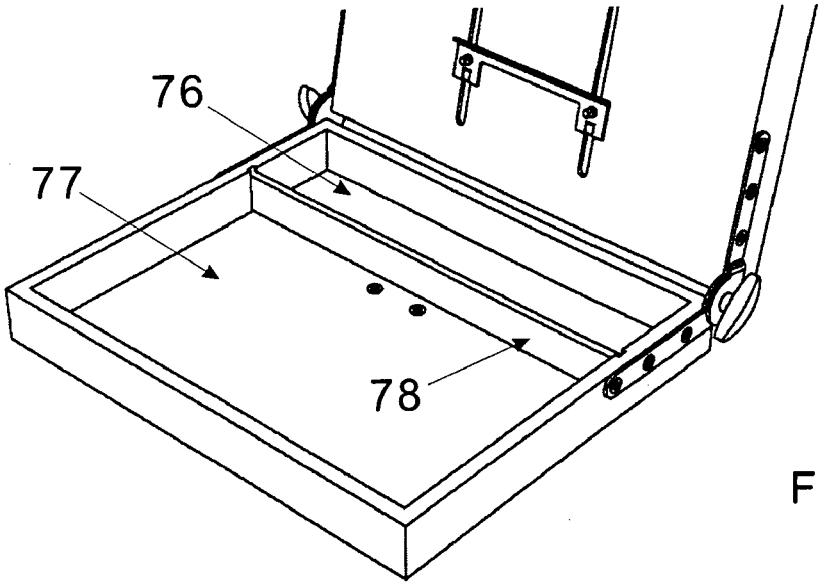
FIG. 16*b* shows the easel of FIG. 16*a* with the separator fully installed.

As shown throughout the many figures, palette box 1 of the present invention forms a container for storing paint and painting accessories. FIGS. 16*a* and 16*b* illustrate an embodiment of an easel having a palette box 1 configured with compartments 76 and 77 separated by a separator 78. Slots 79 and 80 are cut vertically into the face of inner sides 81 and 82, as shown. Separator 78 slides snugly into slots 79 and 80, thereby dividing palette box 1 into compartments 76 and 77. Optionally, palette box 1 may be configured with a plurality of separators 78 to create additional compartments.

Separators 78 may be inserted and removed from palette box 1 as desired. For example, an artist may wish to remove separators 78 while painting in order to use the entire palette box as a palette for mixing paints. After painting, the artist may scrape area 77 clean and store unused paint in smaller area 76. Separator 78 can then be inserted to separate unused paint from area 77. Area 77 can then be used to store other accessories such as paint tubes, brushes, palette knives, etc., that the artist wishes to keep away from wet paint.

Another advantage of an easel according to the invention can be realized when using palette box 1 as a storage area for paint, especially oil paint. Because hinges 3 can clamp easelback 2 tightly onto the top of palette box 1 into the closed position, the easel can effectively seal the palette box from ambient air, thereby preserving paint for a longer time that a palette that is open and exposed. To improve the environmental seal even further, an easel according to the invention may optionally comprise an elastomeric material to seal between the easelback and palette box surfaces. The sealing material may be composed of a synthetic rubber, a synthetic foam weatherstrip, a plastic tape, or any elastomer or other material having good insulation properties.

An easel according to the invention, assembled with the aforedescribed hinges 3, canvas holder 4, support plate 5, and baseplate 57 can provide a secure mounting surface for a wide range of canvas sizes as follows: First, a user mounts the easel to a tripod by connecting the tripod to the baseplate. Then, the user loosens the hinges, opens the easelback to a desired position, and clamps it there by tightening the hinges. The user then positions the lower support plate at a desired height and tightens its thumbscrews. The user unlocks the snap lock, raises the canvas holder to a desired height, rotates the hooks out of their slots, and places a canvas onto the support plate. The user lowers the canvas holder until the hooks meet the top of the canvas, then rotates the hooks outward until they hold the canvas tightly against the easelback. The user then locks the snap lock and tightens the thumbscrews of the hooks. By using this method, a user can quickly set up her canvas and easily adjust its height or angle without undue effort or risk of losing easel parts and hardware.

The invention has been presented in an illustrative style. The various terminology employed throughout should be read in an exemplary rather than a limiting manner. Although some disclosure has been provided for dimensions of various components, other details and dimensional relationships that have not been fully described may be easily ascertained by those skilled in the art after a thorough reading of the disclosure. Accordingly, many modifications and variations within the scope of the invention are possible. Those skilled in the art will recognize that within the scope of the appended claims and their equivalents, the present invention may be practiced in ways other than as specifically described herein.

I claim:

1. An easel comprising:

a first surface bordered by sides;

a second surface bordered by sides;

an axis of rotation;

a first lockable hinge mounted to a side of the first surface and a side of the second surface, the sides in a first plane perpendicular to the axis; and a second lockable hinge mounted to a side of the first surface and a side of the second surface, the sides in a second plane perpendicular to the axis, thereby rotatably connecting the second surface to the first surface and defining the axis between the hinges, whereby the hinges, when unlocked, allow the second surface to rotate relative to the first surface about the axis, and when locked, lock the second surface into a fixed position relative to the first surface, wherein rotatably connecting the second surface to the first surface, and locking the second surface into a fixed position relative to the first surface, are effected exclusively by means of the first and second hinges; and wherein the first surface further comprises a means for attaching the first surface to a tripod.

2. The easel of claim 1 wherein the attaching means further comprises a baseplate having a first portion and a second portion extending from the first portion at an angle of about 90 degrees, the second portion abutting one side of the first surface, and the first portion attached underneath the first surface.

3. An easel comprising:

first and second surfaces;

a vertically adjustable canvas support plate attached to the second surface for supporting and vertically adjusting a canvas;

a vertically adjustable canvas holder attached to the second surface for holding the canvas to the second surface;

an axis of rotation;

one or more slots cut through the second surface in a direction normal to the axis, wherein said canvas support plate further comprises:

one or more mounting screws;

one or more threaded holes located in the support plate; and one or more rails located on the support plate, whereby the mounting screws penetrate the second surface through the one or more slots to engage the one or more threaded holes, and whereby the one or more rails fit snugly within the slots; and first and second hinges, each hinge comprising:

first and second members, each member having a mounting tab and a rotatable overlapping section, the mounting tabs of the first hinge connecting a first side of the first surface to a first side of the second surface, the first sides in a first plane perpendicular to the axis, the mounting tabs of the second hinge connecting a second side of the first surface to a second side of the second surface, the second sides in a second plane perpendicular to the axis and opposite the first sides, such that the overlapping sections are cooperatively aligned to support rotation of the first surface about the axis relative to the second surface wherein each hinge further comprises:

a handle extending outward from the overlapping sections, the handle having a threaded hole;

a friction washer located between the overlapping sections; and a threaded shaft passing through the overlapping sections and friction washer and engaging the threaded hole, rotatably pinning the overlapping sections, thereby maintaining the mounting tabs on substantially the same plane throughout rotation, whereby, tightening the handle clamps the friction washer between overlapping sections, locking the second surface into a position relative to the first surface, and, loosening the handle releases the second surface to rotate about the axis to a desired angle relative to the first surface.

4. An easel comprising:

first and second surfaces;

a vertically adjustable canvas support plate attached to the second surface for supporting and vertically adjusting a canvas;

a vertically adjustable canvas holder attached to the second surface for holding the canvas to the second surface;

an axis of rotation; and first and second hinges, each hinge comprising:

first and second members, each member having a mounting tab and a rotatable overlapping section, the mounting tabs of the first hinge connecting a first side of the first surface to a first side of the second surface, the first sides in a first plane perpendicular to the axis, the mounting tabs of the second hinge connecting a second side of the first surface to a second side of the second surface, the second sides in a second plane perpendicular to the axis and opposite the first sides, such that the overlapping sections are cooperatively aligned to support rotation of the first surface about the axis relative to the second surface wherein each hinge further comprises:

a handle extending outward from the overlapping sections, the handle having a threaded hole;

a friction washer located between the overlapping sections; and a threaded shaft passing through the overlapping sections and friction washer and engaging the threaded hole, rotatably pinning the overlapping sections, thereby maintaining the mounting tabs on substantially the same plane throughout rotation, whereby, tightening the handle clamps the friction washer between overlapping sections, locking the second surface into a position relative to the first surface, and, loosening the handle releases the second surface to rotate about the axis to a desired angle relative to the first surface;

wherein the vertically adjustable canvas holder further comprises:

a slidable shaft;

a shaft housing connected to the second surface, the shaft contained within the housing and slidable therein for vertical adjustment of the canvas holder;

a cross member connected across the shaft at its outermost end; and a means for locking the shaft to the shaft housing.

5. The easel of claim 4 wherein the cross member further comprises one or more hooks, rotatably mounted with respect to the cross member, for holding a canvas.

6. The easel of claim 4 wherein the first surface further comprises a means for attaching the first surface to a tripod.

7. An easel comprising:

first and second surfaces, wherein the first surface further comprises a means for attaching the first surface to a tripod and wherein the attaching means further comprises a baseplate having a first portion and a second portion extending from the first portion at an angle of about 90 degrees, the second portion abutting one side of the first surface, and the first portion attached underneath the first surface;

an axis of rotation; and first and second hinges, each hinge comprising:

first and second members, each member having a mounting tab and a rotatable overlapping section, the mounting tabs of the first hinge connecting a first side of the first surface to a first side of the second surface, the first sides in a first plane perpendicular to the axis, the mounting tabs of the second hinge connecting a second side of the first surface to a second side of the second surface, the second sides in a second plane perpendicular to the axis and opposite the first sides, such that the overlapping sections are cooperatively aligned to support rotation of the first surface about the axis relative to the second surface wherein each hinge further comprises:

a handle extending outward from the overlapping sections, the handle having a threaded hole;

a friction washer located between the overlapping sections; and a threaded shaft passing through the overlapping sections and friction washer and engaging the threaded hole, rotatably pinning the overlapping sections, thereby maintaining the mounting tabs on substantially the same plane throughout rotation, whereby, tightening the handle clamps the friction washer between overlapping sections, locking the second surface into a position relative to the first surface, and, loosening the handle releases the second surface to rotate about the axis to a desired angle relative to the first surface.

8. The easel of claim 7 having a center of gravity, whereby with the second surface rotated about 90 degrees with respect to the first surface, the center of gravity occurs at the baseplate.

9. An easel comprising:

first and second surfaces;

wherein the second surface further comprises one or more slots cut into the sides of the second surface, each slot sized to accommodate a canvas;

an axis of rotation; and first and second hinges, each hinge comprising:

first and second members, each member having a mounting tab and a rotatable overlapping section, the mounting tabs of the first hinge connecting a first side of the first surface to a first side of the second surface, the first sides in a first plane perpendicular to the axis, the mounting tabs of the second hinge connecting a second side of the first surface to a second side of the second surface, the second sides in a second plane perpendicular to the axis and opposite the first sides, such that the overlapping sections are cooperatively aligned to support rotation of the first surface about the axis relative to the second surface wherein each hinge further comprises:

a handle extending outward from the overlapping sections, the handle having a threaded hole;

a friction washer located between the overlapping sections; and a threaded shaft passing through the overlapping sections and friction washer and engaging the threaded hole, rotatably pinning the overlapping sections, thereby maintaining the mounting tabs on substantially the same plane throughout rotation, whereby, tightening the handle clamps the friction washer between overlapping sections, locking the second surface into a position relative to the first surface, and, loosening the handle releases the second surface to rotate about the axis to a desired angle relative to the first surface.

10. The easel of claim 9 further comprising one or more rails having one or more slots, the rails installable between and parallel to two sides of the second surface, the slots sized to accommodate a canvas.

11. An easel for supporting a canvas, comprising:

first and second surfaces;

an axis of rotation;

first and second hinges, each hinge comprising:

first and second members, each member having a mounting tab and a rotatable overlapping section, the mounting tabs of the first hinge connecting a first side of the first surface to a first side of the second surface, the first sides in a first plane perpendicular to the axis, the mounting tabs of the second hinge connecting a second side of the first surface to a second side of the second surface, the second sides in a second plane perpendicular to the axis and opposite the first sides, such that the overlapping sections are cooperatively aligned;

a handle extending outward from the overlapping sections, the handle having a threaded hole;

a friction washer located between the overlapping sections; and a threaded shaft passing through the overlapping sections and friction washer and engaging the threaded hole, rotatably pinning the overlapping sections in cooperative alignment, thereby maintaining the mounting tabs on substantially the same plane throughout rotation, whereby, tightening the handle clamps the friction washer between overlapping sections, locking the second surface into a position relative to the first surface, and, loosening the handle releases the second surface to rotate about the axis to a desired angle relative to the first surface;

a vertically adjustable canvas support plate attached to the second surface for supporting and vertically adjusting the canvas;

a vertically adjustable canvas holder attached to the second surface for holding the canvas to the second surface; and a baseplate for connecting the easel to a tripod, the baseplate having a first portion and a second portion extending from the first portion at an angle of about 90 degrees, the second portion abutting one side of the first surface, and the first portion attached underneath the first surface.

* * * * *